United States Patent [19]

Bengtsson

[11] 4,291,622

[45] Sep. 29, 1981

[54] HAND STAMP HAVING AN ADJUSTABLE STAMP PRINT

[76] Inventor: Algot E. Bengtsson, c/o Boras Stampelfabrik AB Box 17, 501 02 Boras 1,, Sweden

[21] Appl. No.: 103,637

[22] Filed: Dec. 14, 1979

Related U.S. Application Data

[63] Continuation of Ser. No. 958,474, Nov. 7, 1978, abandoned.

[30] Foreign Application Priority Data

Nov. 11, 1977 [SE] Sweden ..... 7712758

[51] Int. Cl.[3] ..... B41K 1/08

[52] U.S. Cl. ..... 101/368; 101/109; 101/372; 101/405

[58] Field of Search ..... 101/103, 109, 327, 368, 101/405, 406, 29, 84, 333, 371, 372, 373, 381

[56] References Cited

U.S. PATENT DOCUMENTS

| | | | |
|---|---|---|---|
| 316,268 | 4/1885 | Horner | 101/333 |
| 851,062 | 4/1907 | Buck | 101/373 |
| 1,069,356 | 8/1913 | Tilden | 101/109 |
| 1,377,786 | 5/1921 | Packard | 101/109 |
| 1,385,490 | 7/1921 | Perez | 101/405 |
| 2,234,422 | 3/1941 | Wiswell | 101/333 |
| 2,280,096 | 4/1942 | Morrison | 101/381 X |
| 2,646,748 | 7/1955 | Brown | 101/405 X |
| 3,227,079 | 1/1966 | Muskin | 101/405 X |
| 3,311,227 | 3/1967 | David et al. | 101/337 |
| 3,631,799 | 1/1972 | Funahashi | 101/327 |
| 3,661,078 | 5/1972 | Hammel | 101/405 |

FOREIGN PATENT DOCUMENTS

| | | | |
|---|---|---|---|
| 492852 | 5/1953 | Canada | 101/327 |
| 1261769 | 4/1961 | France | 101/333 |
| 1357672 | 3/1964 | France | 101/327 |
| 1269460 | 4/1972 | United Kingdom | 101/327 |

*Primary Examiner*—James R. Feyrer
*Attorney, Agent, or Firm*—William A. Drucker

[57] ABSTRACT

A stamp having a fixed text as well as an interchangeable text comprises a base member having a recess in the under side thereof to receive a printing member for the fixed text. The interchangeable text, for instance date indications, is obtained by means of separate stamp units, each having in its upper portion a handle portion and an indication of the text of the stamp in question and in its lower end the printing member for said text and is insertable in a through opening of the base member. The stamp unit and the base member further have interengaging means to lock or latch each stamp unit in a position in which the printing surface of said stamp unit is in level with the printing surface of the fixed stamp.

3 Claims, 3 Drawing Figures

HAND STAMP HAVING AN ADJUSTABLE STAMP PRINT

This is a continuation of Ser. No. 958,474 filed Nov. 7, 1978 now abandoned.

BACKGROUND OF THE INVENTION

Field of the Invention

This invention refers to a hand stamp comprising a stamp body member and a number of separate stamps connectable to said stamp body member.

More specifically the invention refers to hand stamps of the kind referred to which have a fixed text, for instance the name of a company, and interchangeable texts such as date indications.

Hand stamps of the kind referred to are well known in the art. They are however disadvantageous in that the text of the separate stamps is not visible which means that print has to be made to ensure that for instance the correct date is set and in that the mechanism or construction is complicated and difficult to operate.

BRIEF SUMMARY OF THE INVENTION

It is therefore the primary object of this invention to improve such hand stamps such that they are easy to manufacture and to operate and such that the text obtained with the stamp will be visible when the hand stamp is in an upright position.

It is a further object of this invention to provide separate stamps for the changeable text, each of said separate stamps having means cooperating with corresponding means of the stamp body member to arrest or lock the separate stamp to said stamp body member and also a handle portion to be easily grasped such that the stamp in question may be easily inserted in said stamp body member.

BRIEF DESCRIPTION OF THE DRAWINGS

The accompanying drawings, which are incorporated in and constitute a part of this specification illustrate one embodiment of the invention and, together with the following description, serve to explain the principle of the invention. In the drawings

Figure 1:
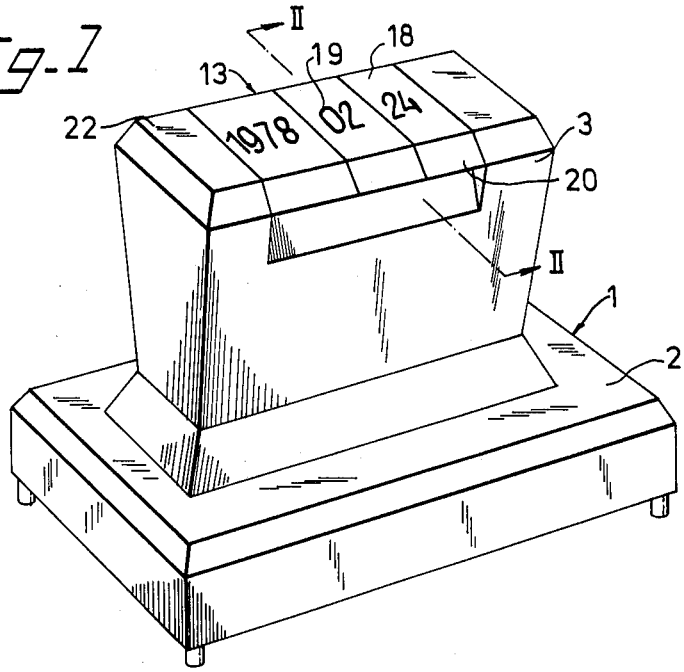
FIG. 1 shows the hand stamp according to the invention seen in a perspective view and in a position ready for a stamping operation.

In the drawing reference numeral 1 generally indicates a stamp body member which in the illustrated embodiment comprises a base 2 and a handle portion 3 providing a first face. The lower side of the base portion has a recess 4 and a fixed printing member 5 is inserted therein and providing a second face. In the embodiment shown said printing member has an opening 5' located where the exchangeable text is desired. Of course, it is also possible to divide the recess 4 by partition walls into two or several spaces, each one accomodating a printing member and in such a case the printing member need not have an opening therethrough. The printing members shown in the illustrated embodiment of the invention are of the self-inking type mentioned above. In order to avoid stamp imprints when the stamp is put upright onto a substrate, the stamp body member has—in a manner known per se—a number of pins 6 projecting from the base portion below the printing members by means of springs 7. The opening 5' communicates with an opening 8 and a somewhat narrower opening 9, which passes through the handle portion 3, providing an opening extending from said first face to the second face of the body Thereby, two shoulders 10 are defined between the openings 8 and 9. Preferably, the upper side of the handle portion 3 is flat, but the portion thereof passed through by the opening 9 is situated in a lower plane than the upper side designated by 22 and bevelled portions 12 project from a lower portion 11 for a purpose to be described.

The hand stamp according to the invention—as mentioned—also comprises a number of replaceable and interchangeable stamping units having the general reference numeral 13. Each separate stamping unit has a stem 14, normally of rectangular section, and has a recess 15 in the lower portion thereof, into which a printing member 16 is inserted. Each stamping unit has a lateral face in contact with a corresponding lateral face of a next stamping unit. Each printing member 16 has a printing face in a common plane with said second face of the body. The stem has beads or projections 17 in two opposite sides thereof for a purpose to be described. The stem continues in the upper portion thereof into a head or handle portion 18 having an indication means 19 displaying the text that each stamping unit, respectively, will provide. The handle portion 18 has side portions 20 projecting in the transverse direction of the stamp. Said parts like the uppermost portion of the stamp body member may terminate in faceted surfaces in a manner illustrated in the drawing. It is evident that recessing 21 will be defined between the side portions 20 and the bevelled or faceted surfaces 12 adjacent the first face of the body and said recessing makes access to the handle portion of each stamp unit very simple. Despite the shape of said handle portions and the upper surface of the stamp body member the stamp will have a substantially even and smooth upper surface.

The beads or projections 17 of the stamp units will engage the shoulders 10 of the stamp body member such that they form cooperating formations giving latching by a frictional grip between said units and the stamp body member that the units will be releasably secured to the stamp body member such with a force, exceeding the force necessary to compress the stamping types in the stamping process.

Figure 2:
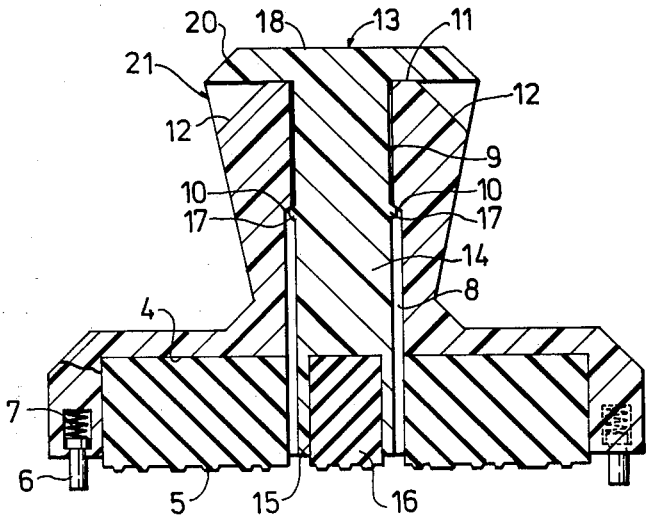
FIG. 2 is a section substantially along line II—II in FIG. 1.
Figure 3:
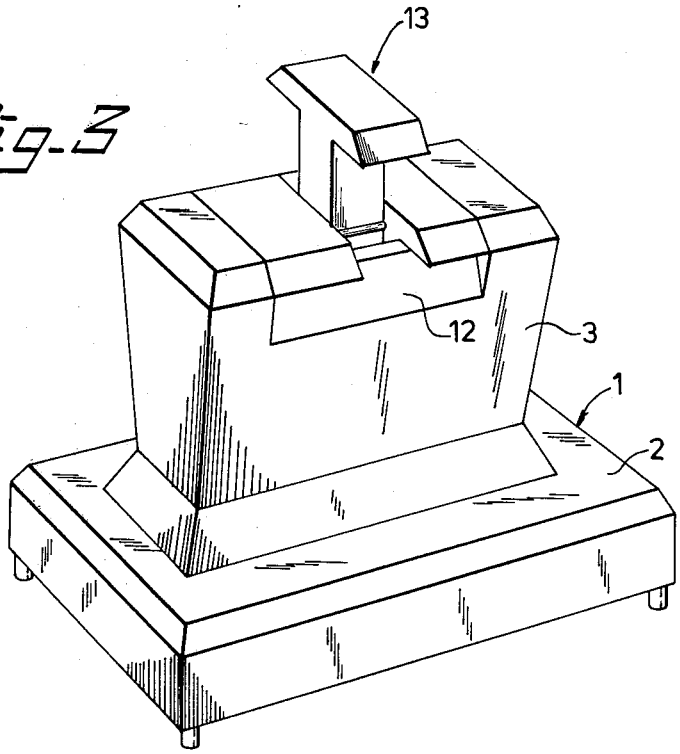
FIG. 3 is a perspective view of the stamp during replacement of one of the separate stamping units.

The hand stamp now described operates in the following manner:

The replaceable stamping units are pushed through the opening 9 in the handle portion 3 until the ribs or projections 17 are seated against the shoulders 10 according to FIG. 2. By making the stamping body member as well as the stamp units from a plastic material having certain elastically yielding characteristics, it is possible, by the exertion of a mild force, to compress the relevant parts of the stamp parts such that the projections may pass through the narrow opening 9 so that they when having passed said passage will snap somewhat outwardly, so that a frictional grip is obtained with the shoulders 10. Of course, it is possible to replace said frictional grip by another latching means for example, which may be manually released and also possible to replace for another type of easily releasable connection, and it is also understood that the handle—if desired—may have one opening each for every stamping unit rather than a single, common opening. When all the stamping units are put into position, the hand stamp is ready for use and naturally, it provides the desired imprint when the stamp handle is pressed downwardly so that the stamping surfaces, which in the upright position of the stamp are kept above the set up plane of the yielding pins, may reach the substrate.

As may be seen in FIG. 1 the text of the stamp is continually visible and as will be evident from the following the stamping units may be easily replaced since the handles thereof are easily accessible.

It is obvious that the structure now described may be utilized for non-self-inking printing members in case the supporting pins 6 and springs 7 are eliminated.

The details of the present invention may be varied within the scope of the claims.

What I claim is:

1. A date indicating hand stamp, for ink printing, comprising:

(i) a stamp body having therein one single opening of rectangular section, said opening extending from a first face to a second face;

(ii) a plurality of stamping units each including a stem portion adapted to pass into said opening and to extend from said first face to said second face, each of said stamping units having one surface thereof in contact with a corresponding surface of a neighbouring stamping unit, a head on each of said stems to abut on said first face in a fully inserted condition of the stem, and a printing member on each of said stems and having a printing face which in said fully inserted condition is in a common plane with said second face, (iii) cooperating formations respectively on said stamp body and on each of said stems serving as latching means to retain said stamping units releasably in said fully inserted condition, (iv) said stamp body being bevelled adjacent said first face such that, with said stamping units in said fully inserted condition, recessing is defined between the bevelled portion of the body and the head of the stamping units to receive the fingers to facilitate removal of the stamping units from the stamp body, (v) said stamp body further having side portions projecting from said first face shaped to align with an outer surface of the heads of the stamping units.

2. A hand stamp, as claimed in claim 1, wherein said latching means comprises projection means on each of said stems, and shoulder means on said stamp body within said opening.

3. A hand stamp, as claimed in claim 1, wherein said stamp body includes at least one printing member providing said second face.

* * * * *